United States Patent [19]

Backstein et al.

[11] 4,406,225

[45] Sep. 27, 1983

[54] IGNITION FUSE FOR SPIN-STABILIZED PROJECTILES

[75] Inventors: Günter Backstein, Meerbusch; Joachim Fiebrich, Duesseldorf; Hans W. Unger, Krefeld, all of Fed. Rep. of Germany

[73] Assignee: Rheinmetall GmbH, Düsseldorf, Fed. Rep. of Germany

[21] Appl. No.: 279,309

[22] Filed: Jul. 1, 1981

[30] Foreign Application Priority Data

Jul. 2, 1980 [DE] Fed. Rep. of Germany ..... 3024966
Oct. 4, 1980 [DE] Fed. Rep. of Germany ..... 3037669

[51] Int. Cl.[3] ..... F42C 15/26

[52] U.S. Cl. ..... 102/235; 102/236; 102/240

[58] Field of Search ..... 102/235, 236, 231, 240, 102/245

[56] References Cited

U.S. PATENT DOCUMENTS

| | | | |
|---|---|---|---|
| 1,316,607 | 9/1919 | Watson | 102/235 |
| 3,033,115 | 5/1962 | Guerne | 102/240 |
| 3,585,935 | 6/1971 | Birkigt | 102/240 |
| 3,830,159 | 8/1974 | Ranalli et al. | 102/235 |
| 3,954,061 | 5/1976 | Rudenauer et al. | 102/240 X |
| 3,994,230 | 11/1976 | Kalin | 102/240 X |

FOREIGN PATENT DOCUMENTS

| | | | |
|---|---|---|---|
| 418897 | 2/1967 | Switzerland | 102/236 |

*Primary Examiner*—David H. Brown

[57] ABSTRACT

In a spin-stabilized projectile, an improved ignition fuse arrangement for a pyrotechnic ignition charge. The ignition charge is mounted in a rotor which is movable from a safety position to an armed (active) position. This rotor is held by actuating means in the safety position and is released by the actuating means and moves to the armed position when the projectile has been subjected to predetermined centrifugal and inertial forces. The actuating means include biasing means which are biased against the rotor to maintain it in its safety position. The actuating means also includes at least two release balls which coact with ball support surfaces of a ball support member which are inclined with respect to the longitudinal axis of the ignition fuse arrangement; at least one blocking ball is operatively mounted in the actuating means for blocking at least one release ball when the projectile is in a non-spinning state and unblocking the release ball when the projectile has reached a predetermined spin velocity, so that the actuating means move to release the rotor against the action of the biasing means which thereby swings into its armed position. This blocking ball constitutes a first safety means. A second safety means is provided in the rear part of the ignition fuse arrangement by means of a massive pin which is slidably mounted in a bore which is parallel but eccentric with respect to the longitudinal axis of the ignition fuse arrangement and this massive pin is adapted to engage the rotor and maintain it in its safety position and to release the rotor when the massive pin has been subjected to predetermined inertial forces.

14 Claims, 7 Drawing Figures

FIG.2
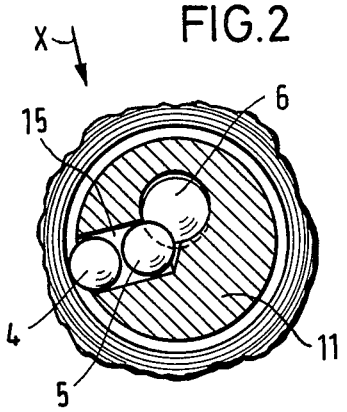
FIG.3
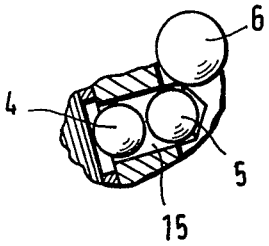
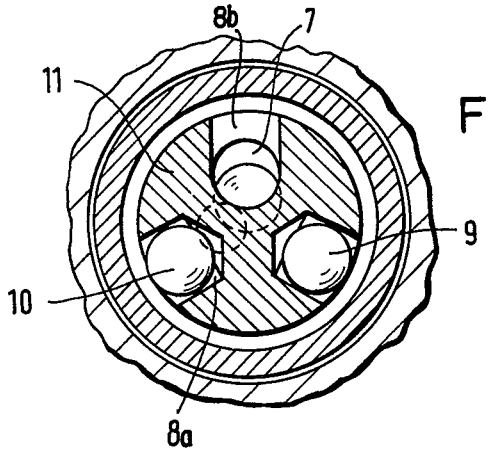
FIG.4
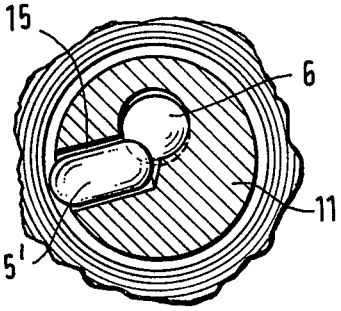
FIG.5

IGNITION FUSE FOR SPIN-STABILIZED PROJECTILES

The invention relates to an ignition fuse for spin-stabilized projectiles. Such ignition fuses are known and are, for example, disclosed in German published application No. DE-OS No. 2,336,880. In such known ignition fuses there are provided one or more blocking balls and levers which are moved into their operative position, so that the support member for these balls then permits the rotor to move (swing) into the operative (ignition) position immediately after the projectile leaves the muzzle.

SUMMARY OF THE INVENTION

It is the general object of the present invention to provide an ignition fuse for spin-stabilized projectiles which has a safety rotor, which meets increased safety standards. Such rotor, which supports the detonator charge, remains for such period in its safety position until the projectile has left the muzzle of the gun and a predetermined (recoil) safety time period has elapsed, during which period the ignition fuse must not be armed so that an unintentional ignition, while the assembly is in a safety position, is eliminated. Furthermore, the rotor is blocked by means of two separate, independently acting safety means, which are unblocked by as different as possible physical forces acting on the projectile, whereby one of these safety means can be unblocked during firing, whereas the second safety means permits the rotor to swing into the ignition position during the flight path of the projectile only after the projectile is acted on by a further projectile- or flight path-specific force which comes into play after the termination of the safety phase.

Hightened safety conditions of the ignition fuse of the invention include also measures, which increase the acoustic sensibility and finally guarantee the self-release of the ignition fuse, insofar as this self-release is not triggered by impact on a target.

BRIEF DESCRIPTION OF THE DRAWINGS

With these and other objects in view, which will become apparent in the following detailed description, the present invention, which is shown by way of example, will be clearly understood in connection with the accompanying drawings, in which:

FIG. 2 is a cross-sectional view along line II—II of FIG. 1;

FIG. 3 is a partial lateral view of the sectional view of FIG. 2 in the direction of the arrow X;

FIG. 4 is a cross-sectional view along line IV—IV of FIG. 1;

FIG. 5 is a cross-sectional view along line II—II of FIG. 1 in which a blocking pin is illustrated in lieu of two blocking balls;

DETAILED DESCRIPTION

Figure 1:
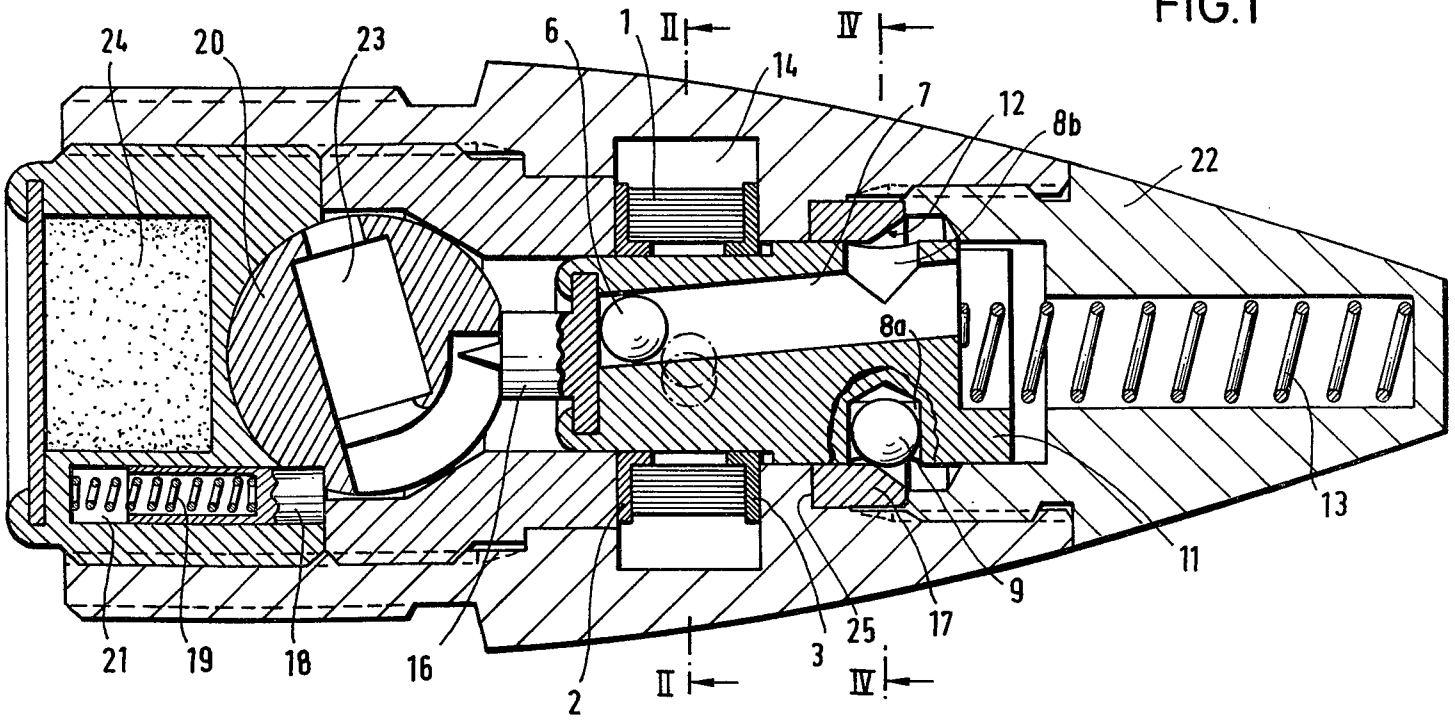
FIG. 1 is a longitudinal axial view of the ignition fuse.
Figure 6:
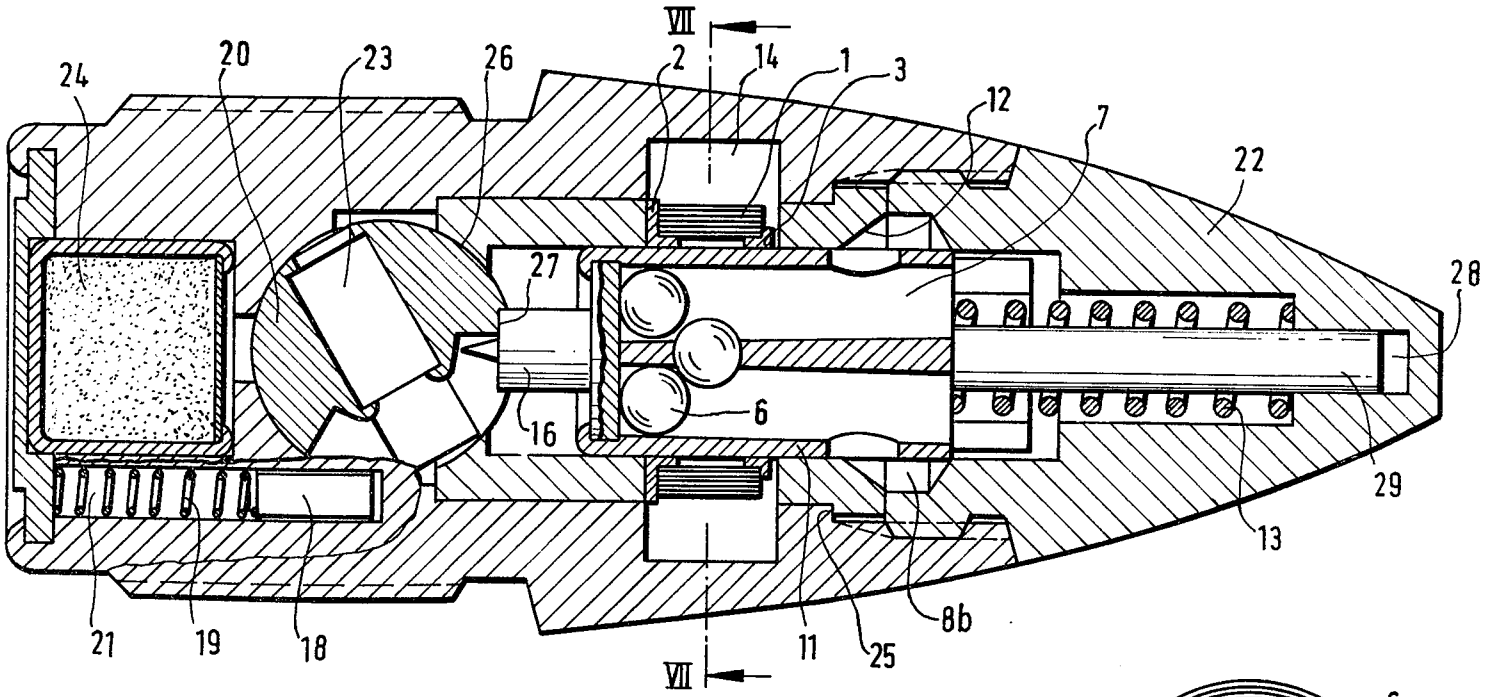
FIG. 6 is a longitudinal sectional axial view of a further embodiment of the ignition fuse of the invention which view is offset by 90 degrees relative to sectional view of FIG. 1.
Figure 7:
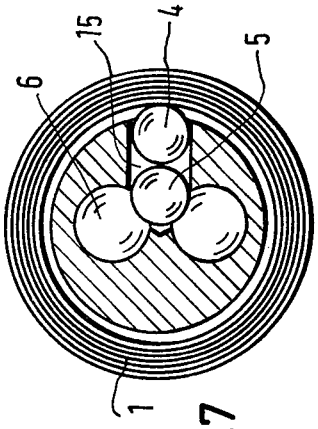
FIG. 7 is a cross-sectional view along line VII—VII of FIG. 6.

FIGS. 1 and 6 illustrate in longitudinal sections two embodiments of the ignition fuse in accordance with the invention which are used for spin-stabilized projectiles.

Those parts of the embodiment of FIG. 6 which are substantially equivalent to corresponding parts in the embodiment of FIG. 1 have been given the same reference number. The ignition fuse encompasses a cylindrical ignition body 22 which consists of the following plurality of interconnected parts; an actuating mechanism which comprises a release spring 13; the ball support member 11; a needle support 16; a rotor 20 containing a pyrotechnic ignition or detonating charge 23 as well as disposed in the rear part of the body 22 a transfer charge 24. When the ignition fuse is in its safety position the release spring 13 biases the ball support member 11 rearwardly of the cylindrical body 22 in such a way that the needle support 16 abuts against a flat surface of the rotor 20 in the safety position of the rotor 20 (FIGS. 1 and 6) and prevents in this way a rotation of the rotor 20 from its safety position. In the embodiment of FIG. 6 the needle support 16 presses, on the one hand, on the rotor 20 and engages therein on a flat surface 27, which is disposed on the exterior periphery 26 of the rotor 20, whereby, in spite of the high moment of inertia of the rotor, a rotation of the rotor 20 from its safety position is prevented.

The safety position of the rotor 20 is guaranteed by a further safety mechanism which is independent from the actuating mechanism 11, 13, 16 which is arranged in the rear portion of the ignition body 22. This further safety mechanism consists, in a preferred embodiment of the invention, of a massive pin 18, which is loaded by a pressure spring 19 and which is slidably disposed in an eccentric bore 21, which extends parallel to the longitudinal axis of the ignition fuse. In the safety position of the rotor 20 the front part of the massive pin 18 engages in a recess disposed in the rotor 20 and prevents a striking of the needle of the needle support 16 of the actuating arrangement 11, 13, 16 against the charge 23 and rotation of the rotor 20 into its active position. Both of the blocking safety systems which block the rotor 20, engage diametrically (actually in the illustrated embodiments at an angular distance from each other of about 120°) into the rotor 20, so that the latter cannot be moved out of the safety position in particular by means of shock-and vibration-loads which occur during the transporting and handling of the projectile. There is provided as driving means for activating the actuating mechanism 11, 13, 16 release balls or spheres 6, 9, 10, (in FIGS. 1 and 2) which are arranged in bores **8*a*, 8*b* of the ball support member 11 and bear against the inclined surface 12 of the inclined ball support 17, whereas in FIG. 6 there are provided a maximum of two release balls 6, which in the safety position of the ignition fuse, are safely held by blocking balls 4, 5 on the bottom of the bore 7. As a consequence the centrifugal forces which form during the rotation of the cylindrical ignition body, the release balls 6, 9, 10 (FIG. 1), 6 (FIG. 2) are caused to travel, whereby, however, the ball 6 can travel outwardly only after release by means of the blocking means 4, 5, 5' onto the inclined bore surface 12 in the radial direction outwardly, thereby moving the ball support 11, together with the thereon secured needle support 16, against the force of the release spring 13, in the direction toward the point of the ignition body 22**.

Thereby, as will be explained hereinafter in detail, the rotor 20 is released from its safety position, so that it can be swung into its active armed position.

In a preferred embodiment of the invention, as is illustrated in FIGS. 1 and 4, two release balls 9, 10 are arranged initially, that is also when the ignition fuse is in a stored condition, in their operative position in the bores 8*a* of the ball support 11. These balls alone would not suffice to lift the ball support 11, together with the needle support 16, under the influence of rotation against the pressure exerted by the release spring 13 from the support surface on the rotor 20. For this purpose a further third release ball 6 is required. In accordance with the invention, however, the third release ball 6, which is required for unblocking the safety fuse, is arranged at the bottom of the bore 7, when the ignition fuse is in the safety position. The bore 7 is inclined from the rear part of the ball support 11, with respect to the longitudinal axis of the ball support 11, and outlets into that bore 8*b* (see FIG. 1), which receives the release ball 6 during the unblocking operation, that is in the active position of the actuating mechanism 11, 13, 16. For purposes simplifying the manufacture, the bore 7 is formed as a through bore and is thereafter closed with the aid of the needle support 16.

In a further embodiment of the invention, which is not illustrated in the drawings, there are provided only two of these release balls. One of these balls is already in a standstill condition in its active working position in a bore of the inclined ball support, whereas the other ball is securely positioned at the bottom of the bore 7 and travels only under the influence of spin into its active working position.

A further embodiment, which is also not illustrated in the drawing, provides that solely one release ball 6 is securely mounted at the bottom of the bore 7 and travels only under the influence of spin into its working position onto the inclined bore surface 12. Thereby a particularly simple construction for the ignition fuse is provided.

In its standstill (inactive) position at the bottom of bore 7, the release balls 6 are blocked by means of blocking means which are arranged in a bore 15 in the ball support 11. As blocking means there can be advantageously provided a blocking pin 5' (FIG. 5) or locking balls 4, 5 (FIGS. 2 and 3). The bore 15 intersects the bore 7 advantageously in such a way that the cross section of the bore intersection of bores 15 and 7 is smaller than the diameter of the blocking means 4, 5, 5', so that they may not completely run into the bore 7. In a radial outward direction the bore 15 is closed by means of a safety in the form of a wound band, which consists of a wound band 1 and a support 2, 3. This wound band safety prevents, in the inactive condition (standstill) of the ignition fuse an exiting of the blocking means 4, 5, 5' in the radial direction outwardly from the bore 15 and thereby a release of the release ball 6. The use of two winding supports 2, 3 furnishes the additional advantage of a secure guiding of the wound band 1.

In order not to impermissibly strongly brake or hinder the wound band 1 of the wound band safety 1, 2, 3 during the unwinding process by means of excessively high centrifugal forces imparted on the locking balls 4, 5, it is advantageous, with ignition fuses for projectiles of very high rotational speeds, to make at least one of the locking balls 4, 5, or the locking pins 5' out of a light material, for example a synthetic material or aluminum.

The inclined ball support or carrier 17 is advantageously formed as an annular ring, the inner inclined surface of which is formed as a truncated conical surface 12; thereby the inclined ball support 17 is advantageously formed so that it is easily exchangeable and is firmly supported on the stepped surface 25 in the ignition body 22. This permits, on the one hand, relative simple working of the very precisely maintained inclined bore support surface 12 and, on the other hand, an easy exchange of the inclined bore support 17 with another one having a differently shaped inclined bore support surface 12 and thereby having a different release characteristic for the ignition fuse.

For safety reasons it is required that the ignition fuse, when not impacting a target, does nevertheless trigger the ignition. This is attained, in that during a slowed rotation of the ignition fuse, the release ball 6 moves radially inwardly on the inclined ball support surface 12, and thereby permits a movement of the needle support 16 in the axial direction into the detonator charge 23 positioned in the rotor 20 which is now in an armed position. In order not to hinder this movement, when the wound band does not completely abut against the exterior wall of the winding chamber 14, the wound band support 3 (FIG. 6), which is positioned more closely to the point of the ignition fuse, has, in accordance with the invention, a reduced diameter relative to the wound band support 2 (FIG. 6) which faces the rear part of the ignition fuse.

In order to increase the impact sensitivity there is, furthermore, slidably disposed in the embodiment of FIG. 6 a cylindrical pin 29 in a bore 28 mounted in the head part (point) of the ignition body 22 which is arranged in such a way that it is surrounded by coaxial spring 13. This pin 29 biases via the ball support 11 the movement of the needle support 16 in the direction of the detonator charge 23.

Details of the blocking by the release ball 6 by means of the blocking means 4, 5, 5' arranged in the bore 15 is further illustrated and explained by means FIGS. 2, 3, 5, and 7 which are understandable without an accompanying detailed description.

Also FIG. 4 requires no detailed description since this figure represents a cross-section along line IV—IV of FIG. 1 and illustrates more clearly the arrangement of the release balls 9, 10 in the bores 8*a* and the ball support 11.

MANNER OF OPERATION OF THE IGNITION FUSE

At firing a projectile which is armed with an ignition fuse of the type described hereinabove, the inertial mass of the pin 18, as a result of the fact that it is in an inactive position, in which it engages with the rotor 20 and prevents the rotation of the latter, is moved rearwardly by inertial forces with respect to the ignition body 22 and thereby releases the rotor 20 against the force of the coil spring 19. The spring constant of the coil spring 19 and the coefficient of friction of the pin 18 which is slidably mounted in the bore 21, are thereby coordinated with respect to each other so that the pin 18, after release of the rotor 20 and also by taking into account the projectile deceleration which occurs on the further flight path, prevent the return of the rotor 20, to its initial position due to the influence of the rotational forces. Due to the influence of the spin of the projectile there is first of all stopped the effect of the wound band safety 1, 2, 3 as a result of which the blocking means 4, 5, 5' move out of the bores 15 in the radial direction and release the release ball 6. In FIG. 1 the release ball 6 then runs at an inclination to the longitudinal axis of the ball support 11 in the bore 7 in the direction toward the point of the ignition fuse, until it enters into the until then unoccupied bore 8*b*.

In FIG. 6 the release balls 6 run first along the bore 7 in the direction toward the point of the ignition fuse, until they enter into the until then non-occupied bores 8*b*. Together with the further release balls 9, 10 which already are in working position, that is the balls already disposed in the bores 8*a*, the release ball 6 lifts, in accordance with FIG. 1, respectively the release balls 6 lift, in accordance with FIG. 6, the ball support 11 via the inclined ball surface 12 against the force of release spring 13 so far that now the rotor 20 is unloaded with respect to the force of the release spring 13 which is applied by means of the needle support 16, and as a result of its mass distribution and under the influence of the centrifugal force the rotor 20 is moved into the ignition position of the detonator 23. In order to be able to move in the ignition position, it is necessary, that the end piece of the needle support 16, which is illustrated in FIGs. 6, can be slid out of the recess 27, disposed in the exterior periphery 26 of the rotor. The ignition position is then attained, when the detonator 23 is aligned with the transfer charge 24 and the needle support 16. The ignition fuse now enters into action as soon as an impact of the projectile occurs or as a result of a spin decrease the return force of the release spring 13 surpasses the centrifugal force which is transferred by means of the release balls 6, 9, 10 onto the ball support 11.

The construction of the ignition fuse in accordance with the invention furnishes in particular an advantage in that the rotor 20 is arrested by two independently acting safety systems in its safety position and that in addition thereto by means of the separate blocking of the release ball a sufficient safety is attained which meets all operative conditions.

Although the invention is illustrated and described with reference to a plurality of embodiments thereof, it is to be expressely understood that it is in no way limited to the disclosure of such preferred embodiments, but is capable of numerous modifications within the scope of the appended claims.

We claim:

1. An improved ignition fuse arrangement for a pyrotechnic ignition charge of a spin-stabilized projectile which is mounted in a rotor, which is adapted to be rotatably displaced from a safety position, in which said rotor is held by actuating means in a safety position, to an armed position, in which said actuating means releases said rotor, said actuating means including safety means which are driven by the spin and inertial forces of the projectile against the action of biasing means opposing such drive, which biasing means maintain said rotor in its safety position, and including ball support surfaces which are inclined with respect to the longitudinal axis of the projectile, the improvement comprising wherein said safety means of said actuating means (11, 13, 16) include at least two release balls (6, 9), a first ball support member (11) having first bores (8*a*, 8*b*); and a second bore (7), and a first release spring (13) biasing said first ball support member (11) towards said rotor (20), whereby one (9) of said release balls (9) is disposed in said bore (8*a*) when the actuating means (11, 13, 16) is in the safety position as well as when said actuating means (11, 13, 16) is in its active armed position, and whereby a further one (6) of said release balls is retained in said second bore (7) of said first ball support member (11) when said actuating means (11, 13, 16) is in its safety position, said first bore (8*b*) and second bore (7) being in communication with each other, said first bore (8) receiving said further release ball (6) when said actuating means (11, 13, 16) is in its active armed position, and wherein said safety means include a further safety mechanism (18, 19, 21) which is operatively mounted in the rear part of said ignition fuse arrangement (22) and is adapted to engage said rotor (20) to prevent its rotation when the rotor (20) is in its safety position.

2. The improvement in an ignition fuse arrangement for a pyrotechnic ignition charge of a spin-stabilized projectile as set forth in claim 1, wherein said further safety mechanism includes a massive pin (18) slidably mounted in a third bore (21) which extends eccentrically and parallel with respect to the longitudinal axis of the ignition fuse arrangement and a second release spring (19) which biases said massive pin (18) towards said rotor (20) so that said pin engages into a first recess in said rotor (20) when the latter is in its safety position.

3. The improvement in an ignition fuse arrangement for a pyrotechnik ignition charge of a spin-stabilized projectile as set forth in claim 2, wherein said second bore (7) extends through said first ball support member (11) at an angle with respect to the longitudinal axis of said ignition fuse arrangement and a needle support member (16) is coaxially mounted on the rear end of said first ball support member (11) thereby closing the second bore (7).

4. The improvement in an ignition fuse arrangement for pyrotechnic ignition charge of a spin-stabilized projectile as set forth in claim 3, including blocking means (4, 5', 5) are operatively mounted in said first ball support member adjacent to the bottom of said second bore (7), said blocking means being made of a light material selected from the group of synthetic material and aluminum and being disposed in a fourth bore (15) which is in communication with said second bore (7) and being adapted to block the forward movement of said release (6) when said rotor (20) is in its safety position.

5. The improvement in an ignition fuse arrangement for a pyrotechnic ignition charge of a spin-stabilized projectile as set forth in claim 4, wherein said blocking means is in the form of a blocking pin (5').

6. The improvement in an ignition fuse arrangement for a pyrotechnic ignition charge of a spin-stabilized projectile as set forth in claim 4, wherein said blocking means is in the form of a two blocking balls (4, 5).

7. The improvement in an ignition fuse arrangement for a pyrotechnic ignition charge of a spin-stabilized projectile as set forth in claim 4, wherein said fourth bore (15) outlets into said second bore (7) in such a way that the cross-section of the intersection of the second (7) and fourth bores (15) is smaller than the diameter of the blocking means (4, 5', 5), so that the latter means cannot completely exit from said fourth bore (15).

8. The improvement in an ignition fuse arrangement for a pyrotechnic ignition charge of a spin-stabilized projectile as set forth in claim 7, wherein a wound band safety (1, 2, 3) which concentrically surrounds said first ball support member (11), and prevents said blocking means (4, 5, 5') from radially outwardly exiting from said fourth bore (15) when said projectile is in a non-spinning state, thereby blocking the release of the release balls (6).

9. The improvement in an ignition fuse arrangement for pyrotechnic ignition charge of a spin-stabilized projectile as set forth in claim 7, including a second annular ball support (17) which includes an internal truncated conical ball contacting surface, said second annular ball support being removably mounted on a stepped annular surface (25) of said ignition arrangement (22).

10. The improvement in an ignition fuse arrangement for a pyrotechnic ignition charge of a spin-stabilized projectile as set forth in claim 9, wherein said massive pin (18) and said needle support member (16) engage said rotor (20) at substantially diametrically opposite regions of said rotor.

11. The improvement in an ignition fuse arrangement for a pyrotechnic ignition charge of a spin-stabilized projectile as set forth in claim 10, wherein the spring constant of the second release spring (19) and the coefficient of friction of the massive pin (18) which is slidably mounted in the third bore (21) are correlated with respect to each other so that after release of the rotor (20) the massive pin (18) is no longer returnable to its starting position under the influence of rotation.

12. The improvement in an ignition fuse arrangement as set forth in claim 11, wherein said wound band safety (1, 2, 3) includes a wound band (1) which is mounted on a pair of support members (2, 3) which axially support said wound band (1) with respect to the longitudinal axis of said ignition fuse arrangement (22).

13. The improvement in an ignition fuse arrangement for pyrotechnic ignition charge of a spin-stabilized projectile as set forth in claim 12, including (a) the exterior periphery (26) of the rotor (20) having a recess (27) into which the needle support member (16) engages when said rotor is in its safety position;

(b) in the forward position of the ignition fuse arrangement (22) an axial bore (28) is provided, a cylindrical rod (29) being slidably mounted therein coaxially with respect to biasing means (13) of said actuating means (11, 13, 16);

(c) said wound band (10 and two support member (2, 3) forming the wound band safety, wherein that support member (3), which is closer to the point of the ignition fuse arrangement (22), has a smaller exterior diameter than the other support member (2) which confronts the rear portion of the ignition fuse arrangement (22).

14. The improvement in an ignition fuse arrangement for pyrotechnic ignition charge of a spin-stabilized projectile as set forth in claim 13, wherein (a) said safety means include a maximum of two release balls (6); and (b) when said ignition fuse arrangement (22) is in the safety position all release balls (6) are blockingly held by blocking balls (4, 5) at the bottom of said second bore (7).

* * * * *